United States Patent [19]

Bond

[11] Patent Number: 4,650,179

[45] Date of Patent: Mar. 17, 1987

[54] HEALTH SPA FOR EXERCISE, RECREATIONAL AND SOCIAL ACTIVITIES

[75] Inventor: Frank Bond, Phoenix, Md.

[73] Assignee: U.S. Health, Inc., Towson, Md.

[21] Appl. No.: 617,256

[22] Filed: Jun. 4, 1984

[51] Int. Cl.[4] ..... E04H 3/14

[52] U.S. Cl. ..... 272/2; 52/236.4; D25/12

[58] Field of Search ..... 272/2, 3; 52/236.3, 52/236.4, 236.7, 33, 169.2, 169.3; D21/114, 115, 118; D25/3, 5, 4, 12; 4/488, 494

[56] References Cited

U.S. PATENT DOCUMENTS

| | | | |
|---|---|---|---|
| D. 222,343 | 10/1971 | Mullen | D25/5 X |
| D. 273,228 | 3/1984 | Cotton | D25/4 X |
| 1,135,764 | 4/1915 | Casey | 4/494 |
| 1,470,567 | 10/1923 | Hasbrouck | 52/33 |
| 1,572,463 | 2/1926 | Bintz | 4/488 X |
| 2,766,046 | 10/1956 | Skrainka | 272/3 |
| 2,924,829 | 2/1960 | Mosier | 52/169.2 X |
| 3,033,499 | 5/1962 | Ash | D25/3 X |
| 3,091,815 | 6/1963 | Krawiec | 52/33 X |
| 3,602,925 | 9/1971 | Thompson | D25/3 X |
| 3,846,947 | 11/1974 | Short | 52/236.3 |
| 4,274,233 | 6/1981 | Currier | 52/33 |
| 4,426,744 | 1/1984 | Love | 4/488 X |

FOREIGN PATENT DOCUMENTS

| | | | |
|---|---|---|---|
| 2720082 | 11/1978 | Fed. Rep. of Germany | 52/236.3 |
| 678153 | 12/1929 | France | 272/2 |
| 729141 | 6/1932 | France | 272/3 |
| 758498 | 3/1933 | France | 272/3 |

*Primary Examiner*—Robert A. Hafer
*Assistant Examiner*—Arnold W. Kramer
*Attorney, Agent, or Firm*—Leonard Bloom

[57] ABSTRACT

A health spa for exercise, recreational and social activities has a first portion for exercise purposes, a second portion for competitive sports activities and "wet" sports activities including a swimming pool, and a third portion intermediate of the first and second portions and intended as a lounge area for socializing. The first portion includes a continuous track, weight training equipment, an aerobics room, and an activities arena for general purposes. The lounge is elevated and overlooks both the activities arena (at one side of the lounge) and, through a glass wall, the pool at the other side of the lounge.

2 Claims, 4 Drawing Figures

HEALTH SPA FOR EXERCISE, RECREATIONAL AND SOCIAL ACTIVITIES

FIELD OF THE INVENTION

The present invention relates to a health spa, and more particularly, to the plan layout of an advanced health spa which combines exercise, recreational and social activities for the physical and psychological enhancement of the club members.

BACKGROUND OF THE INVENTION

An exercise facility, such as a gymnasium, is well known and has been used for many years in schools and athletic clubs. Over the years, these facilities have become more sophisticated and have evolved into second-generation health spas, including weight-training equipment, swimming pools and saunas. The surroundings have also been made more pleasant and inviting by the use of lighting, mirrors, carpeted areas, and chrome-plated equipment. As a result, these health spas have become increasing popular for both men and women club members.

Invariably, however, these health spas have evolved from the basic gymnasium, such that the pool, whirlpool, sauna, aerobic dancing area and the like have been appendages to the basic concept and are not complete integrated facilities. Moreover, the present state-of-the-art in health spas caters basically to the physical needs of the club members and to an extent their recreational needs, but not to their equally important social and psychological needs. While the club members get a good workout, they do not necessarily have fun, nor is the somewhat sterile atmosphere conducive to developing important social contacts.

SUMMARY OF THE INVENTION

Accordingly, it is an object of the present invention to provide a complete integrated facility comprising a health spa catering to the physical, recreational, social and psychological needs of the club members.

It is another object of the present invention to provide a complete facility which is attractive, inviting, and offers a wide variety of equipment and services for the club members.

It is yet another object of the present invention to provide a facility which includes separate areas for various exercises and activities, yet assures privacy within certain areas.

It is a further object of the present invention to assure that the various areas will not interfere with each other, but rather will naturally "flow" from one to another in the use and enjoyment of the facility by the patrons.

It is a still further object of the present invention to assure that while getting a good workout, the patrons will have fun, enjoy the overall experience, and develop good social contacts.

In accordance with the broad teachings of the present invention, the complete facility for exercise, recreational and social activities includes a first portion, a second portion, and a third portion intermediately of the first and second portions. The first portion is enclosed by a continuous trackway and has at least a first area at one end thereof for weight training, a second and totally enclosed area for aerobics, and a third relatively-open area intended for general activities and disposed adjacent to the intermediate third portion. The second portion includes one area for competitive sports activities and further includes another area for "wet" sports, such as a swimming pool. The third intermediate portion includes a lounge for social activities.

In accordance with the further teachings of the present invention, the first area of the first portion is devoted to weight training and includes a plurality of individual exercise machines arranged in a circular array. The first portion further includes an aerobic dance area and a ladies gym, both of which are preferably restricted for female use. The one area of the second portion includes racquetball and squash courts, and the other area of the second portion includes a pool, whirlpool and sauna. The lounge within the third intermediate area includes a bar and restaurant. In a preferred embodiment, the pool is at ground level, the first portion is at a first raised level, and the third intermediate portion (including the lounge for social activities) is at a second and higher raised level.

These and other objects of the present invention will become apparent from a reading of the following specification taken in conjunction with the enclosed drawings.

DETAILED DESCRIPTION OF THE PREFERRED EMBODIMENT

Figure 1:
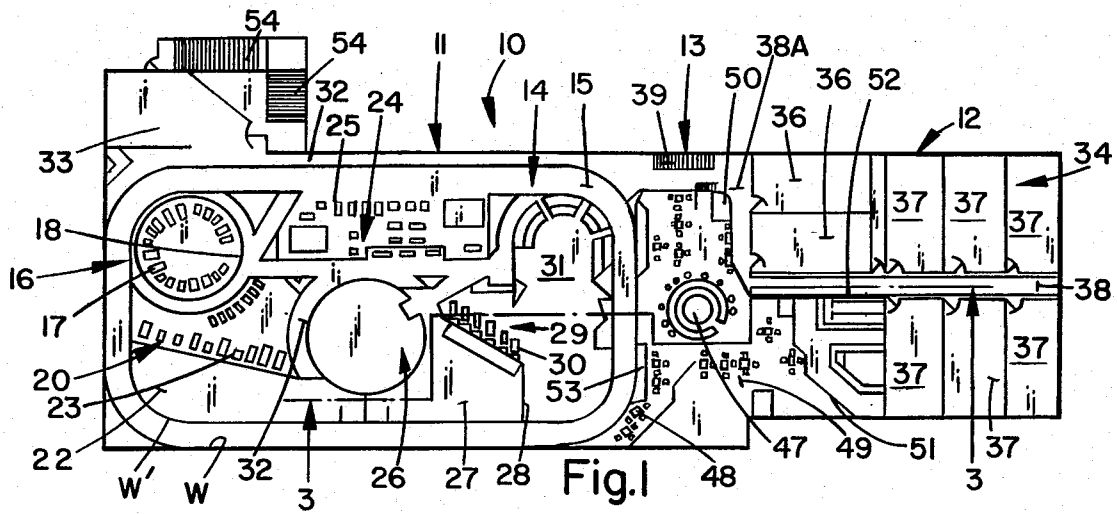
FIG. 1 is a plan layout of a preferred embodiment of the health spa of the present invention, a portion of the pool and whirlpool being shown, the roof removed, and a portion of the wall in the foreground being partially broken away for the sake of clarity (and sectioned) to illustrate the preferred layout of the health spa.
Figure 2:
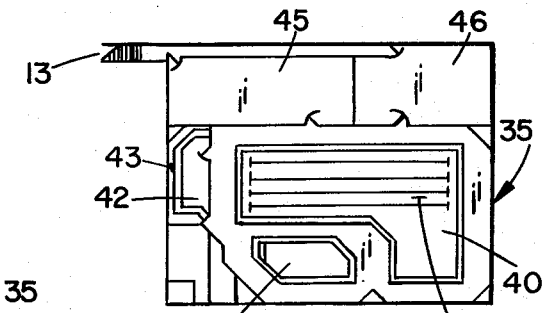
FIG. 2 is a plan layout of the pool area of the facility, the pool area preferably being below the racquetball and squash courts of the plan layout of FIG. 1.

With reference to the drawings, the health spa for exercise, recreational and social activities, denoted as at 10, generally includes a first portion 11, a second portion 12, and a third portion 13 intermediately of the first and second portions. The first portion is intended for various physical exercises; the second portion is intended for certain competitive sports and for so-called "wet" sport or exercise activities, such as swimming; and the third portion is intended for recreational and social activities.

The first portion 11 is enclosed by a continuous track 14. The track is substantially rectangular and is banked at its rounded corners 15. Preferably, the track is 1/10 of a mile, so that ten "laps" around the track constitute a mile run. The track may be divided into a plurality of individual lanes, as for example three, and the track is confined laterally between substantially parallel walls W and W'. Special lighting effects are impressed on the track by overhead lights (not shown) so that boredom is reduced to an absolute minimum, interest is stimulated, and the runner is free to enjoy the track and the run. This theme is dominant throughout the integrated facility of the present invention.

Figure 4:
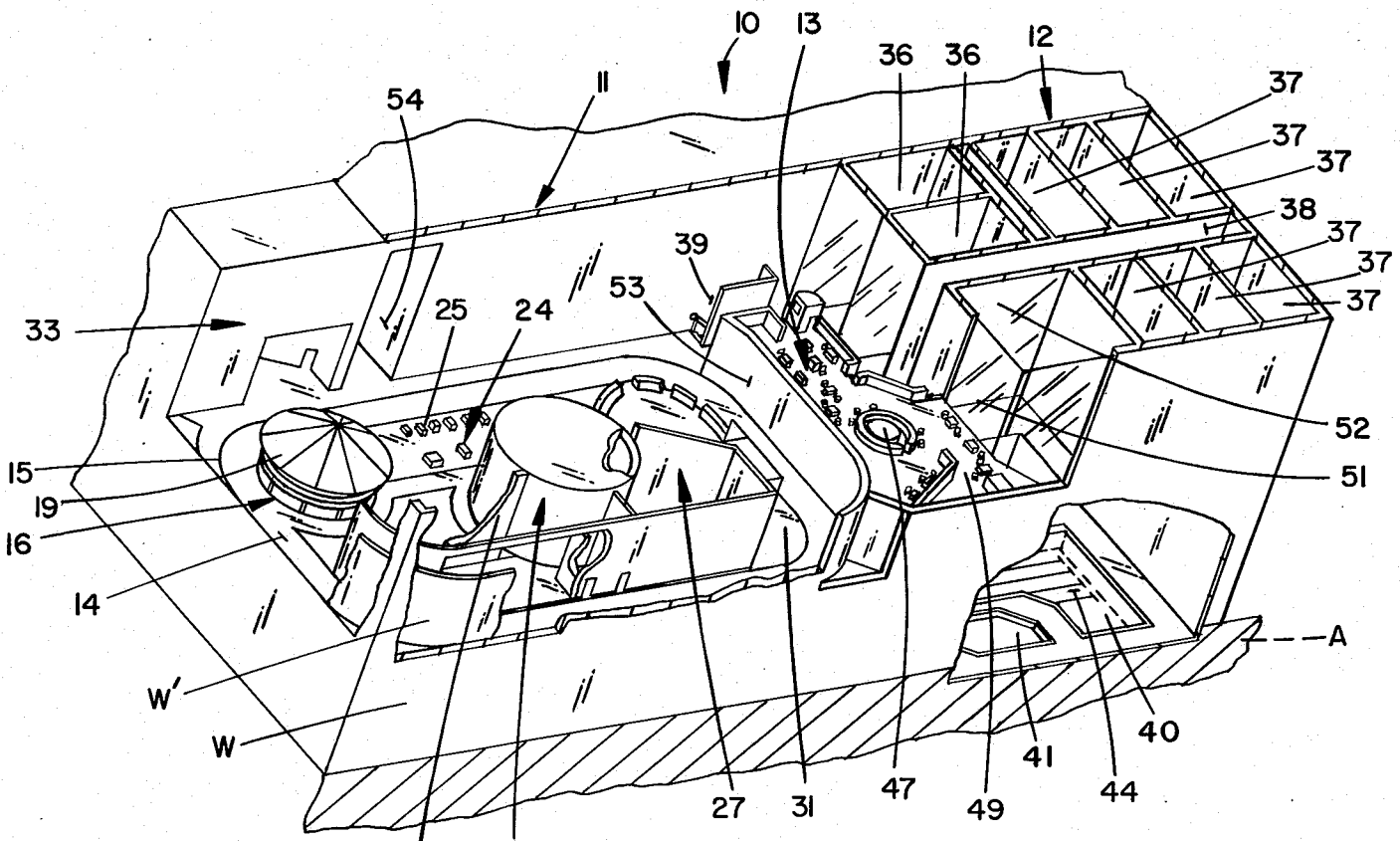
FIG. 4 is a perspective view of the facility, with certain portions thereof broken away to illustrate various areas.

The first portion 11 of the health spa is divided into a number of areas for maximum benefit and enjoyment of the club members. A first area, which provides a circular weight training facility 16, is at the end of the first portion, remote from the remainder of the integrated facility, and includes a plurality of individual exercise machines 17 arranged in a circular pattern. Preferably, the circular weight training facility is elevated slightly above the first portion 11 and is accessible via steps 18. A canopy 19 (shown more clearly in FIG. 4) is provided to cover the circular weight training facility. The exercise machines 17 within the circular weight training facility are preferably of the "UNIVERSAL" type and are available from Universal, P.O. Box 1270, Cedar Rapids, Iowa 52406. These machines are intended to be used in sequence, not individually, and special prerecorded tapes are used to properly instruct the user to advance to the next machine. A second area 20 is disposed adjacent to the first area and is intended for additional weight-training equipment 21, preferably of the "NAUTILUS" type available from Nautilus Sports/-Medical Industries, Inc., P.O. Box 1783, DeLand, Fla. 32720. A third area 22 is available for advanced weight training, such as Olympic class, and is partially enclosed by a wall 23. An "open circuit" area 24 (adjacent to the circular weight training facility) is provided with a variety of weight-training and exercise equipment, one of which is denoted at 25.

Centrally of the first portion 11 of the health spa 10 and confronting the "open circuit" area 24, is a totally-enclosed soundproof room 26 intended for aerobic dancing accompanied by disco-type lights and music, which may be computer controlled. The aerobic room 26 is available to female club members only. Located conveniently adjacent to the aerobic room is a ladies gym 27 which is enclosed by a partition 28 to assure privacy. A fourth area 29 is between the ladies gym and the "open circuit" area and is intended for bicycle-type of exercise machines 30; preferably, these are LIFECYCLE machines of advanced design and are available from Lifecycle, Inc., 18103 Sky Park South, Ervine, Calif. 92714. A fifth area 31 is at the other end of the first portion 11, adjacent to the third intermediate portion 13, and comprises a relatively open area constituting an activities arena for lectures, demonstration of martial arts, and general purposes.

All of the various areas included within the first portion 11 are substantially on the same level, although, as previously noted, the UNIVERSAL circular weight training facility 16 and NAUTILUS area 20 are preferably elevated by several steps above the remainder of the first portion 11. The first portion is provided with carpeted walkways 32 and is further provided with mirrored walls and special disco-type lighting effects (not shown) to provide an exciting, yet pleasant environment, attractive to the club members. As previously noted, the entire facility 10 is available to all of the members, except the aerobics room 26 and ladies gym 27 which are restricted to female members. These areas have pastel colors and special effects (not shown) to "soften" the environment for the female club members and assure complete privacy. Within the first portion 11, overhead TV's (not shown) are strategically located for presenting special instructions, news broadcasts and selected commercial programs. These may be controlled from a central location, such as the office area 33.

The second portion 12 is preferably multi-tiered (as shown more clearly in FIG. 3) and has an upper area 34 for selected competitive-type sports activities and further has a lower area 35 for the so-called "wet" sports or exercise activities. The upper area 34 is preferably on substantially the same level as the first portion 11 and is divided into a number of partitioned enclosed courts. In the preferred embodiment, there are two squash courts 36 (facing the first portion 11) and six racquetball courts 37 at right angles to the squash courts and accessible from a central corridor 38 which, again, is preferably carpeted. The squash courts 36 are at one end of the racquetball courts and are accessible from a corridor 38A which is substantially at right angles to the first corridor 38. Preferably, a first plurality of three racquetball courts confront a second plurality of three racquetball courts and are separated therefrom by the corridor 38.

The lower area 35 of the second portion 12 is accessible via stairs 39 leading from a carpeted walkway disposed adjacent to one long side of the track 14. The lower area 35 includes a twenty meter indoor swimming pool 40, a whirlpool 41, and a sauna 42, the latter having benches 43. The pool is intended for swimming exercises, hence is relatively shallow, and diving into the pool is not permitted. The pool includes a plurality of lanes 44, suitably designated, to accommodate a plurality of swimmers doing "laps" within the pool. A mens locker room 45 and a ladies locker room 46 are provided adjacent to the pool.

The third intermediate portion 13 constitutes a lounge area for relaxing after the workout, socializing, and meeting other club members. This third portion includes a bar 47, which may be circular as shown, and further includes a plurality of cocktail tables and booths 48 for intimate conversations. A food preparation area 49 and a "D.J." booth 50 are also provided. Special curtains (not shown) are provided on the racquetball courts 36 so as to preclude any late-night interference with the lounge area. Of special significance, the lounge area is raised or elevated substantially above the pool 40, as shown more clearly in FIGS. 3 and 4, so that club members can look down on the pool through a glass wall 51. A further glass wall 52, adjacent to corridor 38 and forming a continuation of the outer wall of the second plurality of racquetball courts, overlooks the pool from the corridor 38.

Figure 3:
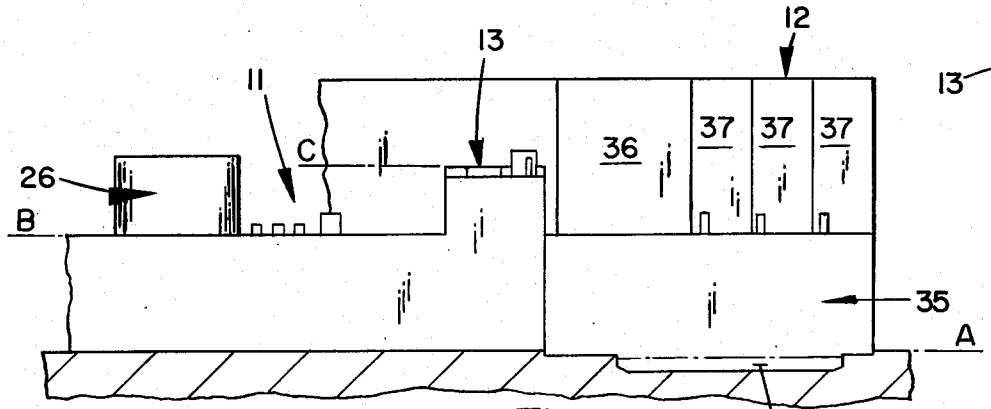
FIG. 3 is a section view, taken along the lines 3—3 of a portion of FIG. 1, with certain portions shown schematically or deleted for ease of illustration.

In a preferrred embodiment, and as shown more clearly in FIG. 3, the swimming pool 40 of the second portion 12 is at ground level A, the first portion 11 is raised above the second portion to level B, and the third intermediate portion 13 constituting the lounge area is raised above the first portion 11 to level C, as shown in the drawings. Thus patrons of the lounge area seated at the cocktail tables 48 along the wall 53, which separates the first and third portions, may look down on the track 14 and the general activities arena 31. Upon entering the facility, the first portion 11 is accessible via stairs 54.

In the preferred embodiment, the facility of the present invention has 43,000 square feet, is staffed by 75 specially-trained instructors and employees, and can accommodate several thousand daily patrons. Each patron (or club member) is given a computerized analysis of their physical condition, body strength, and muscle tone. An exercise program is custom designed for each member, depending upon their objectives and preferences for developing certain body areas, and the members are periodically re-tested to determine the extent of their individual progress. Card-file records (not shown) are maintained and are accessible centerally of the facility. Within the facility, the liberal use of neon lighting, "disco" lighting, video screens, and other special effects generate an environment that is conducive to having fun, getting a good workout, and mingling with other members having similar backgrounds, tastes and objectives.

Accordingly, it will be appreciated that the present invention provides a "third generation" truly-integrated health spa, carefully planned and designed for the ultimate enjoyment and benefit of the club members, and catering to their physical, recreational, psychological and social needs.

Obviously, many modifications may be made without departing from the basic spirit of the present invention. Accordingly, within the scope of the appended claims, the invention may be practiced other than specifically set forth herein.

I claim:

1. A health spa for exercise, reaction and social activities, the spa being housed within an enclosed building and comprising first, second and third portions, the first portion including a track disposed on a given level and having respective end portions, exercise equipment within the track, the third portion including a lounge area substantially adjacent to one end portion of the track, the lounge area being spaced from the track by a wall and being elevated above the level of the track, the lounge area including a bar and tables for rest and socialization, the second portion including a plurality of substantially enclosed courts disposed laterally of the lounge area, wherein the lounge area is between the track and the courts, the courts being substantially on the same level as the track, and the second portion including a pool disposed on a lower level than the courts.

2. The health spa of claim 1, wherein the pool is directly below the courts, and wherein the lounge area has a portion provided with a glass wall overlooking the pool, whereby activities in the pool may be viewed from the lounge area.

* * * * *